United States Patent [19]

Klostermann

[11] Patent Number: 4,577,339

[45] Date of Patent: Mar. 18, 1986

[54] CABLE TERMINATION FOR X-RAY TUBES

[76] Inventor: Heinrich F. Klostermann, 1326 Hoover St., Apt. 10, Menlo Park, Calif. 94025

[21] Appl. No.: 546,615

[22] Filed: Oct. 28, 1983

[51] Int. Cl.[4] ..... H01J 35/00; H01R 13/46

[52] U.S. Cl. ..... 378/121; 339/143 R; 339/143 T

[58] Field of Search ..... 339/107, 141, 140 C, 339/206 R, 206 P, 192 RL, 208, 138, 139 C, 136 R, 143 R, 143 C, 143 T; 313/31, 32, 51; 378/121-144

[56] References Cited

U.S. PATENT DOCUMENTS

| | | | |
|---|---|---|---|
| 2,067,139 | 1/1937 | Ehrke | 313/32 |
| 2,118,434 | 5/1938 | Gross et al. | 378/141 |
| 2,119,069 | 5/1938 | Bouwers | 378/139 |
| 2,121,630 | 6/1938 | Gross et al. | 378/125 |
| 2,332,426 | 10/1943 | Atlee | 378/140 |
| 3,375,481 | 3/1968 | Parnell | 339/107 |
| 4,024,424 | 5/1977 | Eggelsmann | 378/131 |
| 4,222,625 | 9/1980 | Reed | 339/143 C |
| 4,403,109 | 9/1983 | Lehrl et al. | 174/73 R |
| 4,417,093 | 11/1983 | Occhini et al. | 174/25 R |
| 4,418,240 | 11/1983 | Chazelas | 174/73 R |
| 4,431,861 | 2/1984 | Clabburn et al. | 174/73 R |

FOREIGN PATENT DOCUMENTS

| | | | |
|---|---|---|---|
| 0081755 | 6/1983 | European Pat. Off. | 378/121 |

*Primary Examiner*—Craig E. Church
*Assistant Examiner*—Charles F. Wieland
*Attorney, Agent, or Firm*—John M. Haurykiewicz

[57] ABSTRACT

A cable termination is disclosed for high voltage electrical cables for x-ray tubes having inner and outer conductive housings separated by resilient insulating material. The inner conductive housing is at or near the high voltage potential and is adapted to provide even voltage distribution in the insulating material. Electrical contacts are contained within the inner housing which make connection from the cable conductors to feed-through conductors to complete the electrical path across the vacuum envelope of the x-ray tube.

12 Claims, 18 Drawing Figures

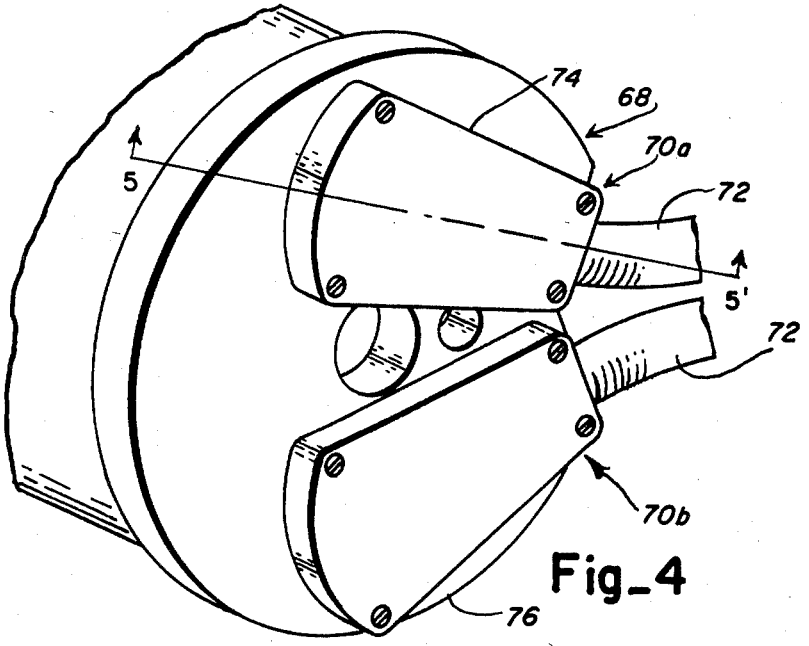
Fig_4
Fig_5
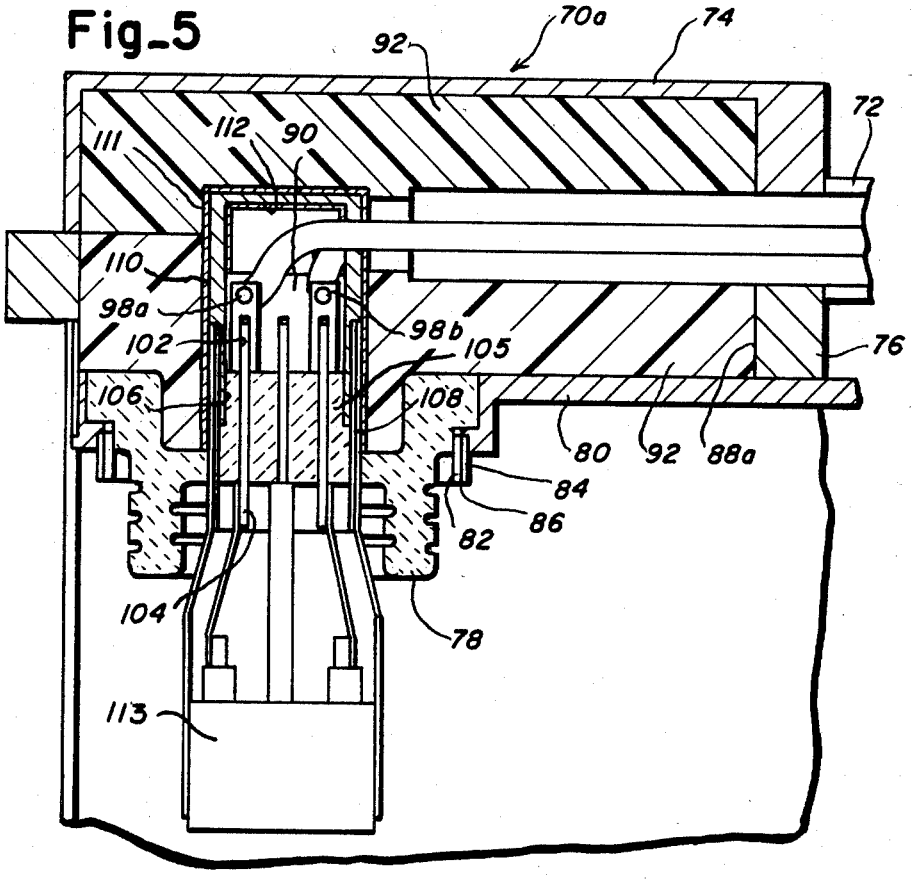

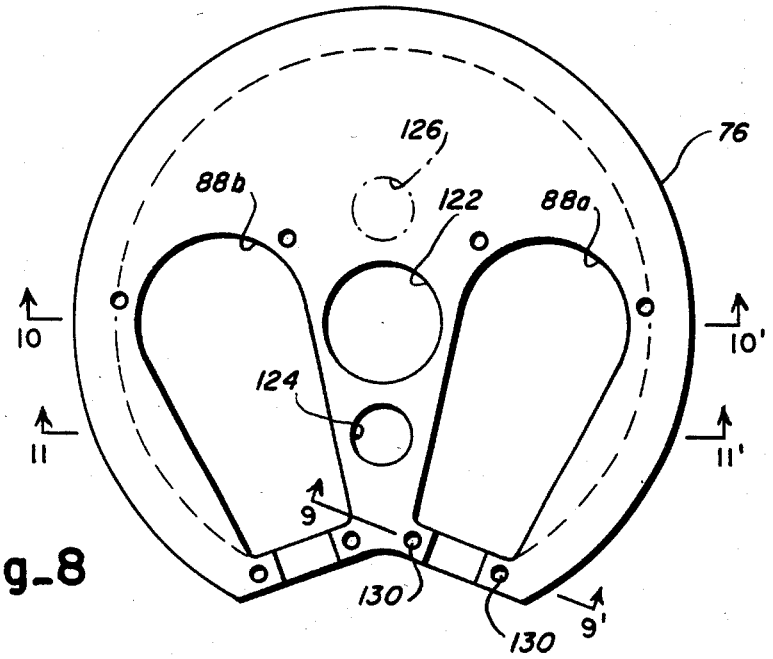
Fig_8
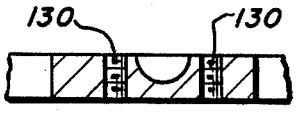
Fig_9
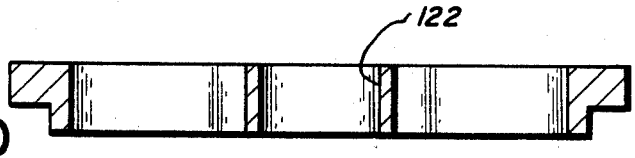
Fig_10
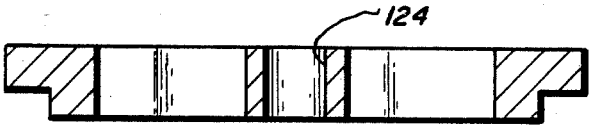
Fig_11
Fig_14
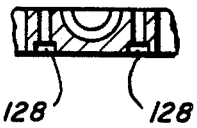
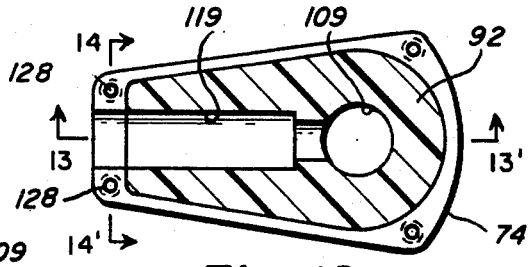
Fig_12
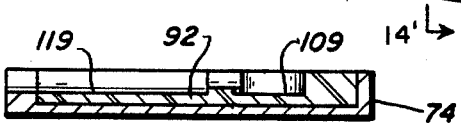
Fig_13

CABLE TERMINATION FOR X-RAY TUBES

REFERENCE TO RELATED APPLICATION

This application has subject matter in common with copending U.S. Ser. No. 326,752 filed Dec. 2, 1981 and assigned to the same assignee as the present application.

BACKGROUND OF THE INVENTION

1. Field of the Invention

This invention is in the field of electrical connectors for use with x-ray emitting tubes, particularly of the rotating anode type.

2. Description of the Prior Art

Referring to FIGS. 1–3, a typical prior art cable termination system for x-ray tubes is shown. FIG. 1 shows the outline of a prior art x-ray tube enclosure 10 which is typically a lead-lined casting made up generally of three intersecting cylinders. The main cylinder portion 12 typically carries a prior art tube insert in a glass envelope 26 containing a rotating anode. Enclosure 10 further has a collimator mounting surface 14 formed as an integral part thereof. Intersecting minor cylinder portions 16*a,b* (positioned as shown to block unwanted x-ray emissions) are the part of the enclosure 10 which provides a housing for prior art cable termination receptacles, shown in more detail in FIG. 2, a view along section 2—2' of FIG. 1.

FIG. 2 shows a prior art female receptacle 18 (shown in halfsection view) mounted in cylinder portion 16*b* of enclosure 10 by means of a locking ring 20. Ring 20 forces flange 22 against a sealing washer 24, to maintain liquid-tight integrity of enclosure 10, which is typically completely oil filled to provide for enhanced electrical insulation and thermal conduction between envelope 26 and enclosure 10. Female receptacle 18 has one or more electrical terminal assemblies or sockets 28 sealed against fluid leakage. FIG. 2 shows one terminal assembly 28 connected to a wire and lug assembly 30 having a number of layers of insulation. Assembly 30 is shown connecting receptacle 18 of cylinder portion 16*b* to the anode terminal 32 of envelope 26. An electrical insulating boot 34 is provided over the terminal end of receptacle 18 to provide additional electrical insulation.

Cylinder portion 16*a* typically contains an identical receptacle 18 whose terminal assemblies 28 are used to connect to the cathode connections of glass tube envelope 26.

The cable side of such prior art termination systems is shown in FIGS. 3*a* and *b*. An insulating plug 36 carries electrically conductive terminals 38 adapted to be received in sockets or terminal assemblies 28. Proper orientation of plug 36 in receptable 18 is provided by key 40 and keyway 42. One or more terminals 38 is connected by means of a bare copper wire 44 through a splice connector 46 to a conductor contained within cable 48 after additional insulation 50 is added to the conductor. Although two connections are shown to terminals 38 and FIG. 3*a*, typically only one connection would be made for the anode connection of an x-ray tube. A resilient gasket 52 is mounted at shoulder 54 of insulating plug 36. A cable flare fitting 56 retains insulating plug 36 to cable 48 by means of a clamp 58. Collar 60 is free to rotate with respect to plug 36 and has an inner threaded ring 62 which mates with threads 64 in cylinder portions 16*a,b* when the mating portions of the terminals are joined. Either straight or curved cable strain relief may be provided by fittings 66*a* or *b*. Once the cable side or plug assembly is complete, it is typically filled with an electrically insulating compound 67 such as polyurethane.

As can readily be seen, this prior art cable termination system comprises a considerable portion of the total x-ray tube enclosure voume. In addition, it requires a substantial amount of manual assembly of many small parts, thus resulting in a relatively complicated and costly cable termination system. Finally, the complicated nature of the parts and steps of such prior art plug assemblies required their construction to be performed by trained personnel using equipment lending itself only to in-factory use. A consequence of this is that plug assemblies have proven difficult to install in hospitals and other locations of x-ray tube users. For example, the assemblies of FIGS. 3*a,b* cannot readily be routed through electrical conduit which may be present in x-ray installations. More particularly, the bulky and rigid construction of such prior art plug assemblies prevents "snaking" prior art high voltage cables through curved conduit and has required oversize conduit as well.

SUMMARY OF THE INVENTION

The present invention overcomes the disadvantages of such prior art cable termination systems by providing a cable termination which does not use a plug or cable side assembly and which may be compactly secured directly to an x-ray tube insert which corresponds to the glass tube envelope 26 of prior art x-ray tubes. The absence of a plug assembly on the tube end of the supply cable permits installation in smaller and more circuitous conduit than do the prior art type assemblies. This cable termination system is particularly designed to be useful with x-ray tube inserts which have tube envelopes which are made partly or entirely of metal. In accordance with the present invention, a cable termination is provided having inner and outer conductive shields separated by a resilient material which provides for electrical insulation and mechanical clamping of the supply cable. In addition, the inner conductive shield is adapted to provide even distribution of voltage stress between the inner and outer shields. The inner shield contains an electrical contact which mates with an electrical conductor mounted in a vacuumtight insulator on the x-ray tube insert envelope, thus providing for an electrical circuit path from the cable through the vacuum wall or envelope of the tube insert. It may be noted that this cable termination does not require oil for electrical insulation (as does the receptacle of the prior art) and hence is compatible with x-ray tubes which operate without oil, as for example, as disclosed in my copending patent application, U.S. Ser. No. 326,752.

BRIEF DESCRIPTION OF THE DRAWINGS

FIG. 4 is a perspective view of the exterior of the cable termination of the present invention.

FIG. 5 is a section view along line 5—5' of FIG. 4 of the preferred embodiment of the cable termination of the present invention.

FIG. 8 is an end view of the end plate shown in FIG. 4.

FIGS. 9–11 are section views as indicated in FIG. 8.

FIG. 12 is a plan view of the inside of the cover shown in FIG. 4.

FIGS. 13 and 14 are elevation section views as indicated in FIG. 12.

DETAILED DESCRIPTION

Figure 1:
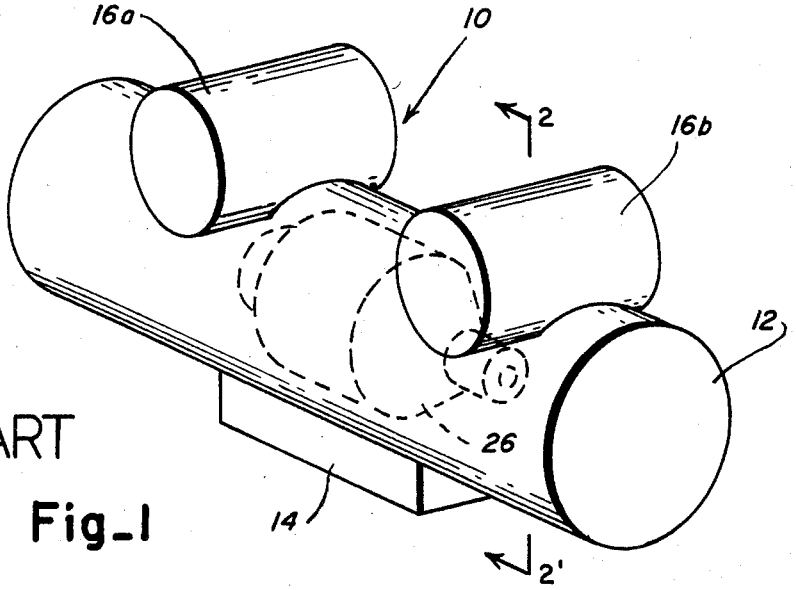
PRIOR ART Fig 1
FIG. 1 is a perspective view of a prior art x-ray tube enclosure.
Figure 2:
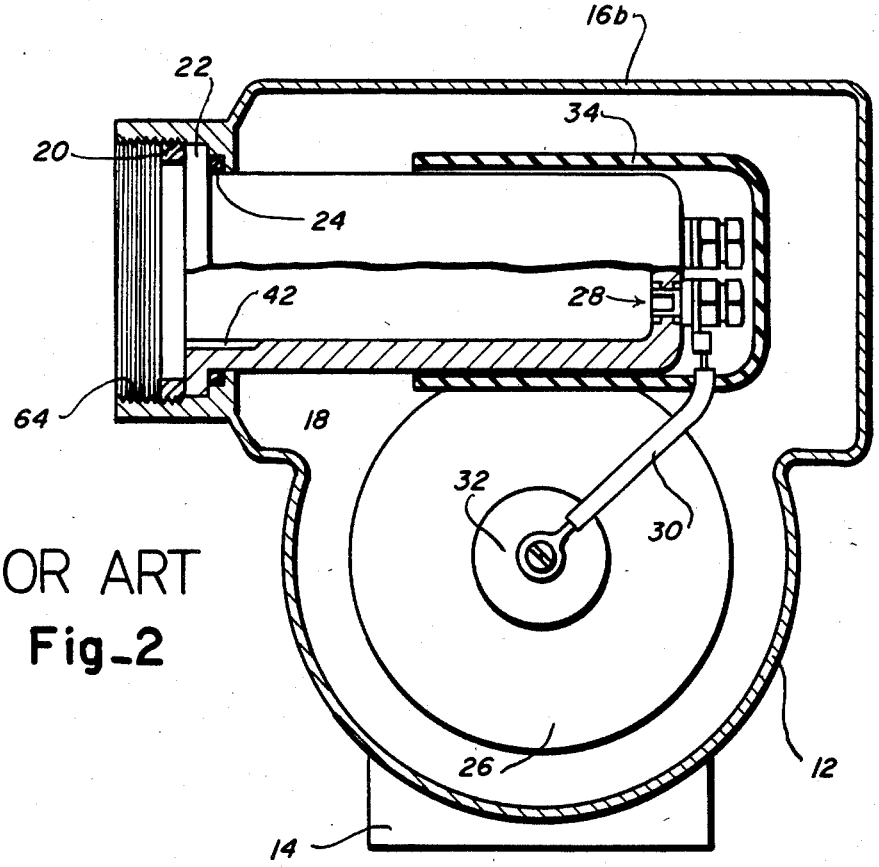
PRIOR ART Fig 2
FIG. 2 is a view along section line 2—2' of FIG. 1.
Figure 3A:
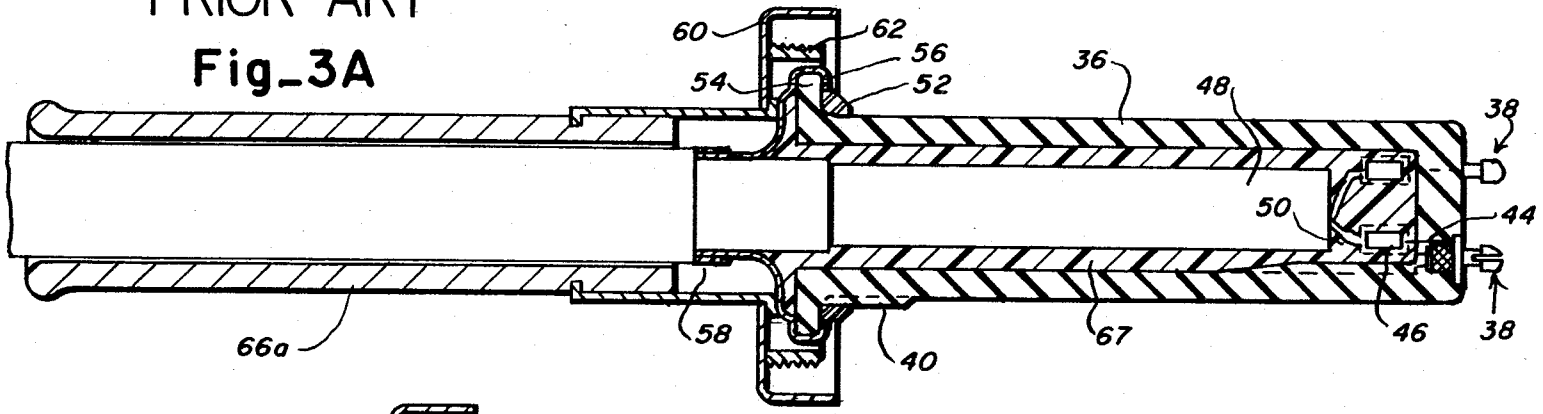
PRIOR ART Fig. 3A
FIGS. 3*a* and 3*b* are section views of prior art cable termination assemblies.
Figure 3B:
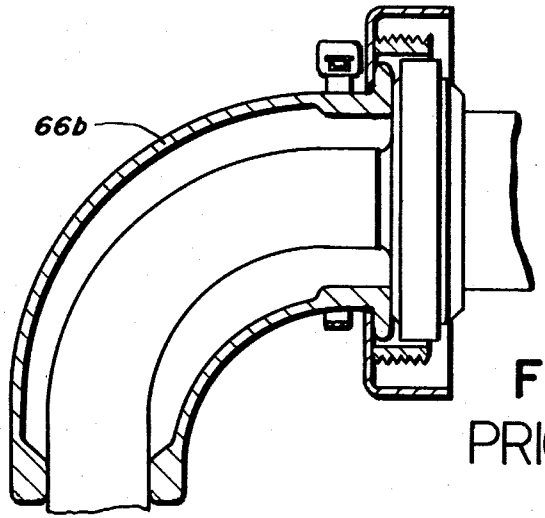
Fig. 3B PRIOR ART

Referring now more particularly to FIG. 4, a perspective of the termination end of a metal encased x-ray tube insert 68 is shown. Two identical outer housings 70*a,b* protect and mechanically secure a pair of the high voltage cables 72 which are connected to the x-ray tube 68. Each of outer housings 70*a,b* is comprised of a removable or disengageable cover 74 and a mating portion of a single termination end plate 76. End plate or frame 76 may, however, be formed of more than one piece, if desired. Outer housings 70*a,b* may be formed of a conductive material or alternatively may be non-conductive if a conductive shield or layer is otherwise provided which encloses each cable connection compartment. Preferably outer housings 70*a,b* are formed of metal such as aluminum which gives the desired mechanical protection and durability while at the same tide providing an electrical shield, preferably at ground potential.

Referring now more particularly to FIG. 5, a section view along line 5—5′ of FIG. 4 is shown, disclosing details of the cathode cable termination within outer shield or housing 70*a*. The anode termination is identical except that it carries only one conductor. This embodiment shows a ceramic insulating stud or base 78 mounted in a metal end wall 80 of tube 68. Wall 80 and stud 78 form a part of the vacuum barrier or envelope for tube 68. Each of stud 78 and wall 80 carries a sealing ring 82, 84, preferably formed of Kovar, which forms a vacuum-tight seal when welded together at periphery 86. Termination end plate 76 is attached to metal end wall 80 by conventional means, as for example, by machine screws which pass through counterbores in plate 76 and are received in threaded, blind holes in wall 80.

Referring now also to FIG. 8, end plate 76 has apertures 88*a,b*. Returning to FIG. 5, aperture 88*a* is filled with a resilient insulating material 92 to provide for electrical isolation between a set of high voltage contacts 90 and outer housing 70*a*. Insulating material 92 must be able to withstand voltage between contacts 90 and housing 70*a*, of at least 87.5 KV. It has been found that polyurethane plastic or room temperature vulcanizing (RTV) silicone rubber is suitable for insulating material 92 which must be formed void free, that is, it must not contain entrapped air or gas bubbles or openings to avoid ionization breakdown.

Outer shield or housing 70*a* for the cathode cable termination further includes a cover 74, also filled (void free) with polyurethane or RTV insulating material 92.

Figure 6:
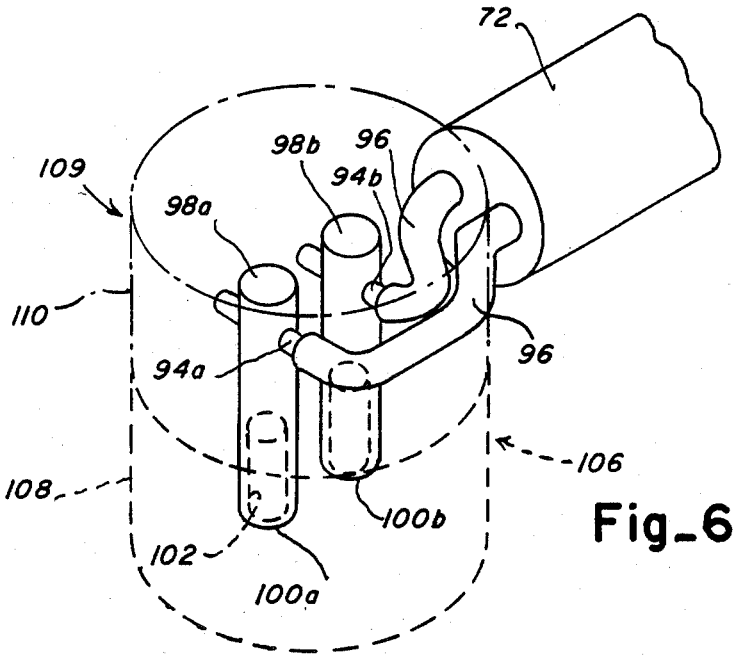
FIG. 6 is a perspective view showing details of the electrical connection at the end of the cable.
Figure 7:
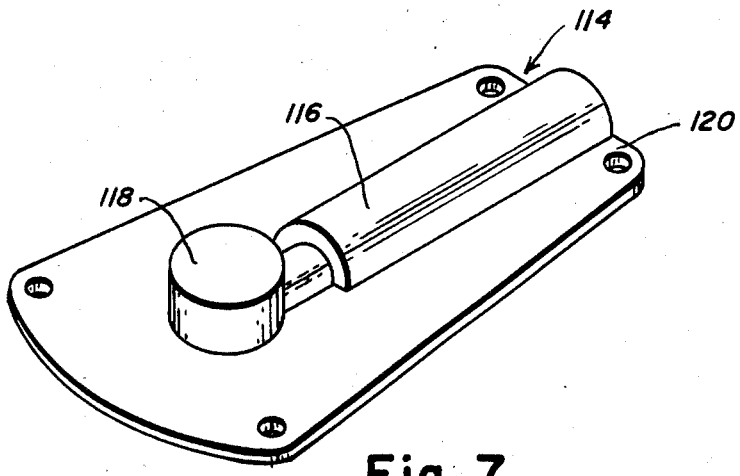
FIG. 7 is a perspective view of a molded plug useful in manufacturing parts for the present invention.

Referring now to FIG. 6 in addition to FIG. 5, a perspective view of the details of the cathode cable conductor-to-contact electrical connection is shown. Cable 72 carries a plurality of inner conductors 94*a,b* each of which are insulated individually by a layer of insulation 96. Each inner conductor 94*a,b* is individually electrically connected to an electrical contact 98*a,b* as for example, by soldering conductor 94*a* to a proximal portion of contact 98*a*. Each of contacts 98*a,b* has a distal portion 100*a,b* forming a hollow cylinder 102. Each hollow cylinder mates with a respective electrical feedthrough conductor or pin 104. Alternatively, contact 98*a* may be formed integrally as a part of conductor 104 and inner conductor 94*a* may be soldered or otherwise electrically connected directly to pin 104. It should be understood that additional contacts 98*c*, 98*d*, etc. (similar to 98*a,b* but now shown) may be included in the set of high voltage contacts 90 to connect to a grid or to additional cathode filaments in the x-ray tube. Contacts 98*a–d* are carried in a ceramic plug or core 105 which is secured to a feedthrough sleeve 108, preferably formed of Kovar.

An inner chamber 109 which conforms to sleeve 108 and cover 110 is formed by insulating material 92 as may be seen more clearly in FIGS. 12 and 13.

An inner conductive shield or housing 106 is formed by a cathode feedthrough sleeve 108 and an electrically conductive cover 110. Alternatively or in addition to sleeve 108 and cover 110, a conductive layer or coating 111 may be provided on the surface of inner chamber 109 to serve as inner conductive shield 106. In FIG. 6, sleeve 108 is shown in phantom by a dotted line, while cover 110 is shown in phantom by a dot-dash line. Cover 110, which is a closed-end cylinder, may be made of metal, or of a resilient conductive material. Inner surface 112 of cover 110 is preferably provided with an insulating layer to prevent shorting of contacts 98*a,b*. Inner conductive shield 106 is preferably electrically connected to one feedthrough conductor 104. This may be accomplished by an electrical connection between one feedthrough conductor 104 and sleeve 108 in cathode cup 113 in a manner not shown, but well known in the x-ray tube field.

A still further alternative is to omit inner chamber 111 and inner shield 106, and to fill all the space between contacts 90 and outer conductive shield 70*a* with insulating material such as polyurethane, RTV or silicone grease, so as to exclude all air between contacts 90 and outer shield 70*a* again to avoid ionization breakdown.

It is to be understood that contacts 98*a,b* typically are close in electrical potential to each other, differing only by a few volts, while collectively they may at many tens of thousands of volts electrical potential with respect to the outer shield 70*a*. To provide for an even distribution of the stress due to the electric field between contacts 90 and outer shield 70*a*, the inner conductive shield 106 provides a smooth or uniform surface, i.e., lacking sharp edges, to evenly distribute electrical stress when inner housing 106 is at or near the electrical potential of contacts 90. This avoids the problems associated with sharp-edged parts carrying high voltage. In addition, the space within sleeve 108 and cover 110 containing contacts 98*a,b* need not contain any special dielectric and may simply be air when inner shield or housing 106 is at or very near the high voltage potential of contacts 90.

Referring now to FIG. 1, a plug or core 114 may be used to form insulating material 92. Core 114 may be clamped between cover 74 and termination end plate 76 to form insulating material 92 into the desired configuration. Core 114 has a first projection 116 corresponding to the shape of cable 72. Core 114 similarly has a second projection 118 corresponding to inner conductive shield or housing 106 and forming inner chamber or cavity 109. Core 114 further has a web or gasket 120 bisecting or bifurcating projection 116 and intersecting projection 118. In practice, core 114 is held in place until insulating material 92 cures or sets to its final configuration. At that time, core 114 is removed and the mating halves of outer conductive housings 70*a,b* (containing insulating material 92) are ready for assembly. Alternatively, core 114 may have a slightly thickened periphery to cause insulating material 92 to be "overcast", i.e., slightly larger than its corresponding cavity. This will result in compression of insulating material 92 when cover 74 is attached to endplate 76, excluding all air and mechanically clamping cable 72 within the housing 70*a*. It has also been found desirable to make the diameter of first projection 116 slightly less than the diameter of the supply cable to be clamped. Preferably, the cavity diameter will be 0.03 inches less than the cable diameter to be clamped, giving an "interference" fit which will ensure exclusion of air between the cable and the insulation formed by projection 116.

If it is desired to form a conductive layer or coating 111 on the surface of inner chamber 109 or on the exterior of insulating material 92, a conductive filler such as carbon black may be introduced into the desired surface region of insulating material 92 in sufficient proportion to render the surface region electrically conductive.

Referring now more particularly to FIGS. 8–11, additional details of termination end plate 76 may be seen. FIG. 9 shows a partial sectional view of the cable clamp portion which mates with the cover portion shown in FIG. 14. FIG. 10 shows a diametral section view of end plate 76 illustrating apertures 88*a,b* and aperture 122 provided to accommodate a separate fan motor for the tube (not shown). FIG. 11 shows an additional sectional view illustrating aperture 124 which preferably contains an exhaust tube used to obtain the vacuum in tube insert 68. An alternative location for aperture 124 is shown at location 126 in FIG. 8.

Referring now more particularly to FIGS. 9 and 12–14, cover 74 is secured to end plate 76 by threaded fasteners such as cap screws received in apertures 128. Cover 74 contains insulating material 92 having portions of cavity 109 (formed by projection 118) and semi cylindrical cavity 119 (formed by projection 116.) Mating apertures 130 (in FIG. 9) are threaded.

Figure 15:
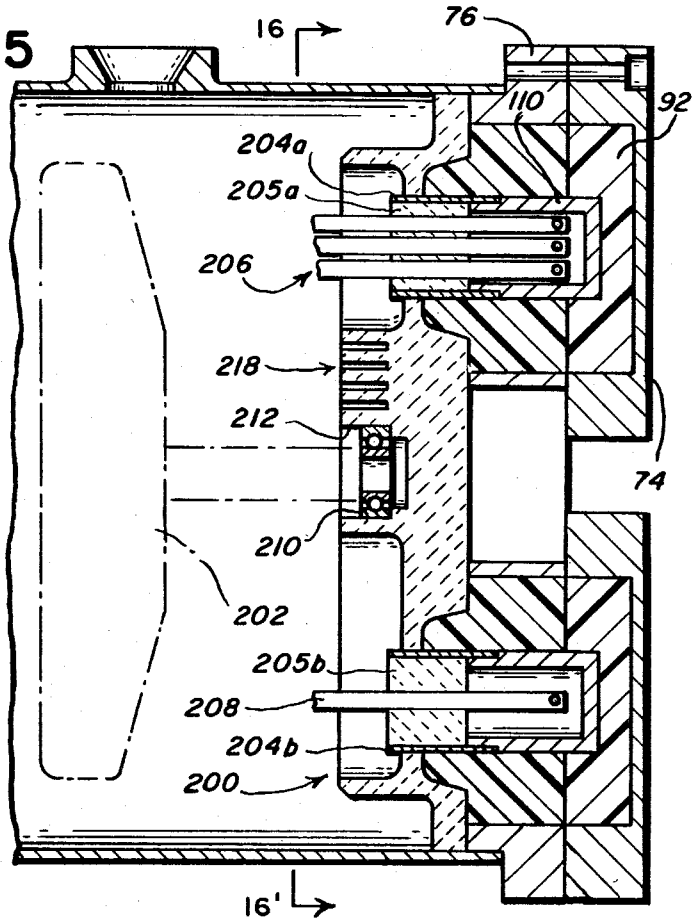
FIG. 15 is a section view of an alternative embodiment of the present invention.
Figure 16:
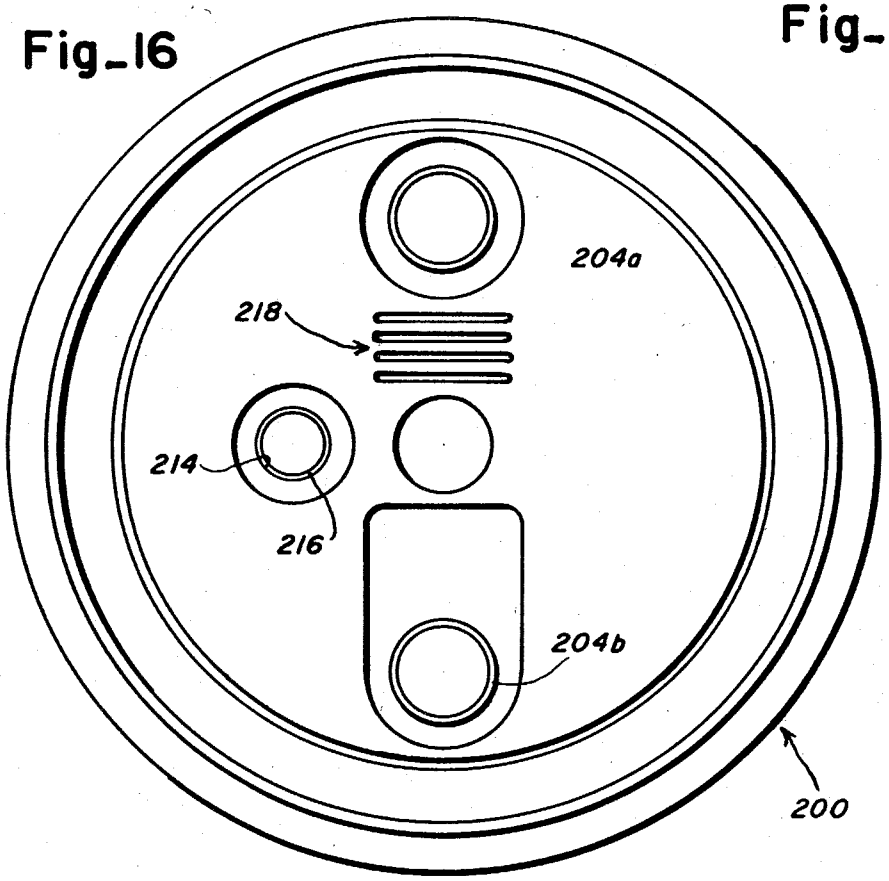
FIG. 16 is a plan view along section line 16—16′ of FIG. 15.

Referring now more particularly to FIGS. 15 and 16, an alternative embodiment of the present invention is shown. In this embodiment a ceramic end plate 200 replaces and serves the function of end wall 80 and ceramic insulating stud 78, (of which there were one each for the cathode and anode connections in the embodiment of FIGS. 4 and 5) in addition to providing a bearing support for rotating anode 202, shown in phantom. More particularly, end plate 200 carries feedthrough sleeves 204*a,b* and ceramic plugs or cores 205*a,b* for the cathode and anode electrical connector pins 206, 208 respectively. End plate 200 carries anode bearing 210 in a recess 212 to provide for rotatable mounting of anode 202.

In this embodiment, cover 110 of the inner conductive shield or housing 106, insulating material 92, end plate 76 and cover 74 are as disclosed in the previous embodiment of FIG. 5. Aperture 214 is provided with a sleeve 216 used to exhaust the tube to provide the necessary vacuum. Grooves or slots 218 may be provided in end plate 200 to increase the surface path length from anode to cathode electrical potentials within the tube.

Figure 17:
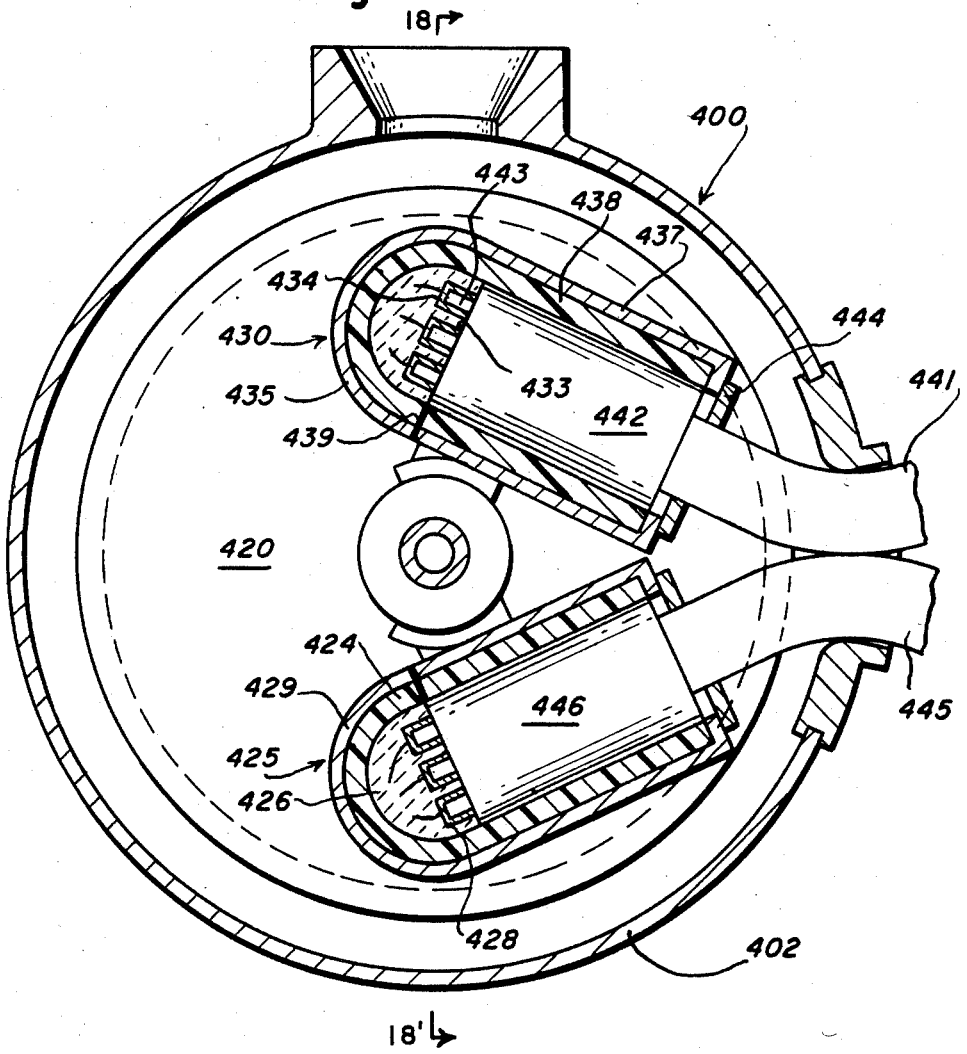
FIG. 17 is a partial end section view of an alternative embodiment of the present invention.
Figure 18:
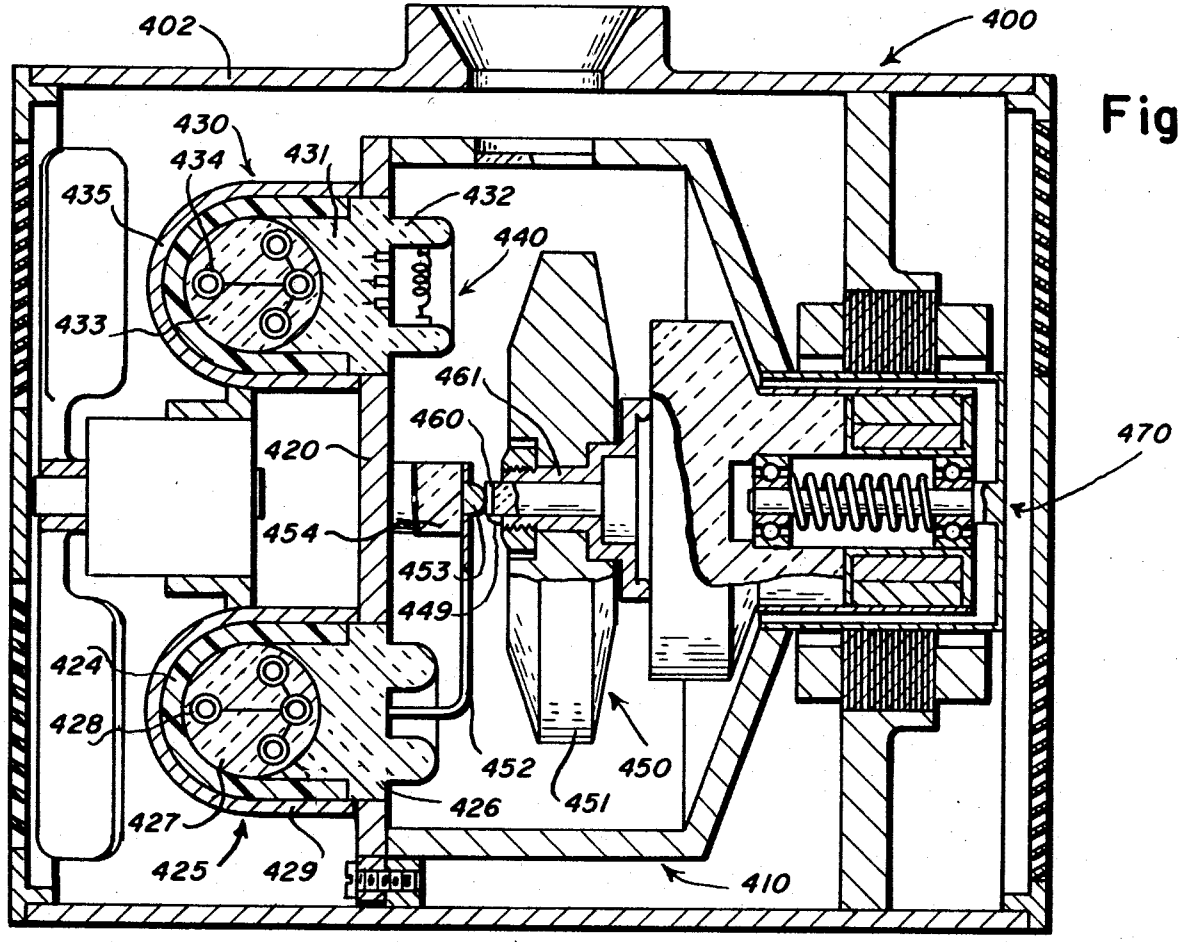
FIG. 18 is a section view along line 18—18′ of FIG. 17.

A still further alternative embodiment of the invention herein is found in the x-ray tube 400 of FIGS. 17 and 18. The x-ray tube 400 generally comprises a tube envelope 410 having an anode assembly 450 rotationally mounted therein, the anode assembly including an anode 451 and the rotor portion of a motor drive 470. The tube envelope 410 is received in a housing 402, which mounts the stator of the motor drive. The tube envelope includes cable terminations, and is cooled by a fan which circulates air through the housing surrounding the tube envelope.

The x-ray tube 400 has a cathode 440 mounted to the end wall 420 opposite the anode 451, and receiving its power via cable 441 through terminal 430. Terminal 430 comprises a ceramic or glass stud 431 sealed to and extending through the end plate 420 of the tube envelope. The ceramic stud 431 has a cup portion 432 extending into the tube, and which mounts one or more filaments and the grid comprising the cathode 440 of the x-ray tube 400. With reference to FIGS. 17 and 18, the outside end of the ceramic or glass stud 431 has a flat, sideways facing surface 433 in which plug receptacles 434 are fitted. Wires are embedded in the stud to connect the plug receptacles with the filaments and grid, as appropriate. A metal shield 435 is secured to the end plate 420 and has a curved closed end portion 436 generally surrounding the protruding stud and an elongated portion 437, U-shaped in section, extending along the end plate 420. Plastic insulation 438 is positioned between the metal shield 435 and stud 431, and defines an opening therein for receiving the terminal end 442 of the cathode supply cable 441. The terminal end 442 of the cathode supply cable has a plurality of plugs 443, such that it may be inserted into the opening in the plastic insulation 438 and plugged into the plug receptacles 434 on the stud 431. The terminal end 442 is shaped for this purpose, and includes a flange 444 which may be secured to the metal shield for retaining the cable. A narrow air channel 439 is provided from the interface of the cable terminal end and the stud, the air channel 439 leading through the plastic insulation and metal shield, such that air may be pushed out of the opening in the pastic cover as the cable's terminal end is inserted.

The anode supply cable 445 is terminated at the tube envelope in a similar manner. The terminal 425 also comprises a ceramic or glass stud 426 extending through and sealed to the end plate 420, the stud 426 having a flat, sideways facing surface 427 in which plug receptacles 428 are formed. A metal shield 429 is secured to the end plate 420, and has a plastic insulation 424 fitted therein for receive bag a terminal end 446 of the anode supply cable 445, which plugs into the plug receptacles 428. The plug receptacles 428 are connected to a wire lead 452 which extends into the x-ray tube envelope and has an end terminal 453 supported on a ceramic stud 454 mounted to the end plate and extending toward the anode, with the metal plate 460 on the rotating anode assembly in contact therewith. A wire lead 449 from the metal plate to the metal sleeve 461 completes the electrical circuit to the rotating anode.

The x-ray tube 400 operates in the usual aanner, i.e., a high voltage potential is applied to the anode 451 via the anode cable 445, anode terminal 425, lead wire 452 and terminal 453. The cathode is heated and grid voltage applied, and the motor drive 470 is operated to rotate the anode while x-rays are being produced.

The invention is not to be taken as limited to all of the details thereof as modifications and variations thereof may be made without departing from the spirit or scope of the invention.

Accordingly, what is claimed is:

1. An improvement in x-ray tubes of the type comprising a metal tube envelope, a rotating anode assembly therein and drive means for it, a cathode and power supply means for the anode and cathode including supply cables, the improvement comprising terminal means for connecting the supply cables to the anode and cathode, including:

an insulating stud sealed to and extending through the generally flat end wall of the tube envelope, the insulating stud having a flat surface perpendicular to the end wall on the outside of the tube envelope;

(b) plug receptacles mounted in the flat surface of the stud, and wire means embedded in the stud and extending from the plug receptacles to the interior of the tube for connection with the anode or cathode;

(c) metal shield means secured to the tube end wall, the metal shield having a first end surrounding the protruding stud and a second open end spaced apart therefrom;

(d) insulating material within the metal shield and defining an opening extending from the flat surface of the insulating stud to the open end of the metal shield; and (e) a terminal end fitting receiving the supply cable and including pins extending from the end thereof, the terminal end being sized to fit into the opening in the insulating material with the pins received in the plug receptacles.

2. An improvement in x-ray tubes as defined in claim 1 wherein a small air path is defined leading from the flat face of the stud to the exterior of the metal shield, to permit air to escape from the opening in the insulating material as the terminal end fitting is inserted therein.

3. A cable termination for connecting an electrical supply cable to an x-ray tube comprising:

(a) an outer conductive shield;

(b) a resilient insulating material received in and conforming to said outer conductive shield and defining an inner chamber;

(c) a vacuum tight insulator mounted on a conductive portion of the x-ray tube and carrying a feedthrough electrical conductor for making a vacuum-tight electrical connection through the vacuum envelope of the x-ray tube and adapted to make electrical connection with said cable conductor; and (d) an inner conductive shield conforming to said inner chamber for electrical shielding and adapted to provide even distribution of voltage stress between said inner shield and said outer shield and having electrically conductive first and second shield portions, (i) said first shield portion having a first aperture for receiving a conductor of said electrical supply cable, and a second aperture for connection with said x-ray tube, and (ii) said second shield portion carried by said vacuum tight insulator and circumscribing said feedthrough electrical conductor for maintaining shielding through said insulator and having a receiving aperture at the exterior surface of said insulator adapted to mate with said second aperture of said first shield portion to extend the electrical shielding of said inner conductive shield such that a shielded electrical path is established from said electrical conductor and said supply cable to the interior of said x-ray tube through said vacuum-tight insulator.

4. The cable termination of claim 3 wherein said inner conductive shield is formed by a conductive coating on said inner chamber.

5. The cable termination of claim 3 wherein said inner conductive shield is formed by an inner metallic layer conforming to said inner chamber such that air is excluded from between said inner metallic layer and said insulating material.

6. The cable termination of claim 3 wherein said outer conductive shield is formed by a conductive coating on the exterior of said resilient insulating material.

7. The cable termination of claim 3 wherein said outer conductive shield comprises a metal housing.

8. The cable termination of claim 3 further comprising an electrical contact interposed between said electrical conductor in said cable and said feedthrough electrical conductor wherein said contact is releasable from said feedthrough conductor.

9. The cable termination of claim 3 wherein said resilient insulating material completely fills the space between said inner and outer conductive shields.

10. The cable termination of claim 3 wherein said inner conductive shield is electrically connected to said feedthrough conductor to maintain said inner conductive shield at an electrical potential sufficiently small with respect to said feedthrough conductor such that ionization of air within said inner conductive shield is prevented.

11. The cable termination of claim 10 wherein said inner conductive shield is electrically shorted to said feedthrough conductor.

12. An improvement for use with x-ray tubes of the type having an anode and cathode within a tube vacuum envelope, the improvement comprising terminal housing means to electrically connect a high voltage supply cable to an x-ray tube including:

(a) a stud assembly mounted in a conductive end wall of said tube vacuum envelope, the stud assembly comprising:

(i) an electrically insulating base, (ii) a first conductive means for providing electrical connection across the tube vacuum envelope at an electrical potential different from that at said end wall, (iii) a second conductive means for providing electrical shielding across the tube vacuum envelope and having an open-ended boundary portion exterior of the x-ray tube vacuum envelope and circumscribing said first conductive means and insulated from said end wall by said base, and having another end portion interior of the tube vacuum envelope, said second conductive means adapted to substantially evenly distribute voltage stress between said first conductive means and said end wall, and (iv) means for sealing said stud assembly to said end wall to maintain vacuum integrity of said tube vacuum envelope (b) a terminal housing having:

(i) a conductive frame secured to said end wall circumscribing and spaced from said second conductive means, and filled with an insulating material in said circumscribing space between said boundary portion of said second conductive means and said frame, (ii) an inner conductive cover having an open-ended boundary portion adapted to mate with the open-ended boundary portion of said second conductive means and enclosing the region between said second conductive means and said supply cable to provide electrical shielding for said region, (iii) an outer conductive cover adapted to be secured to said frame and filled with insulating material defining a cavity aligned with said second conductive means and adapted to mate with said inner conductive cover to exclude air from between said inner conductive cover and the insulation filling said outer conductive cover, and (iv) cable retention means to mechanically locate and support said supply cable in said terminal housing; and (c) electrical contact means contained within said second conductive means and said inner conductive cover for:

(i) electrical connection to a conductor within said supply cable at a proximal region of said contact means, and (ii) electrical connection with said first conductive means at a distal region of said contact means.

* * * * *